US008187125B2

(12) United States Patent
Kaufman

(10) Patent No.: US 8,187,125 B2
(45) **Date of Patent: *May 29, 2012**

(54) TENNIS THROW TRAINER

(76) Inventor: Alexander Kaufman, Aspen, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/794,403

(22) Filed: Jun. 4, 2010

(65) Prior Publication Data

US 2010/0261559 A1 Oct. 14, 2010

Related U.S. Application Data

(63) Continuation-in-part of application No. 12/423,237, filed on Apr. 14, 2009, now Pat. No. 7,740,550.

(51) Int. Cl.
*A63B 69/38* (2006.01)

(52) U.S. Cl. ..... 473/459

(58) Field of Classification Search ..... 473/459, 473/473, 474, 422, 462, 447, 476, 479–481, 473/483, 486
See application file for complete search history.

(56) References Cited

U.S. PATENT DOCUMENTS

| | | | | |
|---|---|---|---|---|
| 3,017,183 | A * | 1/1962 | Chalcroft | 473/483 |
| 4,023,798 | A | 5/1977 | Pronin | |
| 4,141,550 | A | 2/1979 | Denizman | |
| 4,162,070 | A * | 7/1979 | Georges | 473/462 |
| 4,502,685 | A | 3/1985 | Phillips et al. | |
| 4,858,920 | A * | 8/1989 | Best | 473/480 |
| 4,956,775 | A * | 9/1990 | Klamer et al. | 473/480 |
| 5,011,143 | A | 4/1991 | Jones | |
| 5,158,281 | A * | 10/1992 | Williams | 473/483 |
| 6,389,368 | B1 * | 5/2002 | Hampton | 702/179 |
| 6,418,179 | B1 * | 7/2002 | Shieh | 377/5 |
| 6,758,769 | B2 * | 7/2004 | Nelson | 473/480 |
| 7,740,550 | B1 * | 6/2010 | Kaufman | 473/459 |
| 2003/0181268 | A1 * | 9/2003 | Nelson | 473/480 |
| 2005/0255946 | A1 * | 11/2005 | Liu | 473/479 |
| 2010/0261559 | A1 * | 10/2010 | Kaufman | 473/459 |
| 2010/0267496 | A1 * | 10/2010 | Johnson | 473/447 |

FOREIGN PATENT DOCUMENTS

FR 2609405 A1 * 7/1988

OTHER PUBLICATIONS http://www.mansionselect.com.
http://www.mansionselect.com/tennistraining.html.
http://www.mansionselect.com/tennis-serves-training-equipment-toss-trainer.html.

* cited by examiner

*Primary Examiner* — Raleigh W. Chiu
(74) *Attorney, Agent, or Firm* — Albert O. Cota

(57) ABSTRACT

A training device that will train a player to throw the ball to the correct height and angle for a serve is provided. The device includes a pole that adjusts from about four feet to twelve feet in height to suit a player's need. The pole is supported by a base and includes an toss hoop at the top of the pole. A photo-sensor is provided at the toss hoop to record a valid toss when a ball is tossed upwardly through the hoop within a predetermined height range and descends through the hoop prior to the serve. A basket may be positioned at the base for retrieving the tossed practice balls. The base legs and toss hoop fold away for easy storage and transport.

2 Claims, 3 Drawing Sheets

TENNIS THROW TRAINER

CROSS REFERENCE TO RELATED APPLICATIONS

This application is a continuation-in-part of pending application Ser. No. 12/423,237, the contents of which is incorporated herein in its entirety.

BACKGROUND OF THE INVENTION

The invention relates generally to a tennis throw training device for improving a tennis player's serve by giving the player a correct throw, and more particularly to a device having an hoop of variable height from the ground used as a guide for the player to throw the ball during a serve.

There are various tennis training devices currently on the market. One such device that seeks to improve a tennis player's toss during a serve relies on having a coach to hold a training hoop at a correct height above the student's head. The student then tosses the ball during a serve through the training hoop.

Notwithstanding the availability of such tennis training devices, there exists the need to provide a device that will allow tennis players to improve on their own, or practice any time alone.

SUMMARY OF THE INVENTION

Generally speaking, in accordance with the invention, a tennis throw training device that will train a player to throw a tennis ball to the correct height and angle for a serve is provided. The device includes a pole mounted on a base that adjusts from about four feet to twelve feet in height to suit a player's need. The pole includes a upper toss hoop mounted to the top of the pole. In one embodiment of the invention, a basket or container is placed adjacent to the base for retrieving the tossed practice balls when thrown correctly.

The toss hoop is located at the correct height and horizontal position for a player who throws the ball up during a serve. When the ball is tossed through the toss hoop a predetermined distance and then descends through the hoop, it registers a valid. This will insure that the ball will be in the correct position to connect with the racket.

Accordingly, it is an object of the invention to provide a device to guide a tennis player in throwing a tennis ball to the correct height and location for a serve.

It is another object of the invention to provide a tennis serve training device that does not require a coach or second person to hold the device during practice.

It is a further object of the invention to provide a training device that is suitable for players of varying height.

It is yet another object of the invention to provide a training device having a photo-sensor to indicate that the tennis ball has been tossed to the correct height and position.

It is yet further object of the invention to provide a training device having a container for capturing the tennis balls used during training.

Still another object of the invention to provide a training device that is easily collapsible for storage after training.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is had to the following description taken in connection with the accompanying drawing(s), in which.

DETAILED DESCRIPTION OF THE INVENTION

Figure 1:
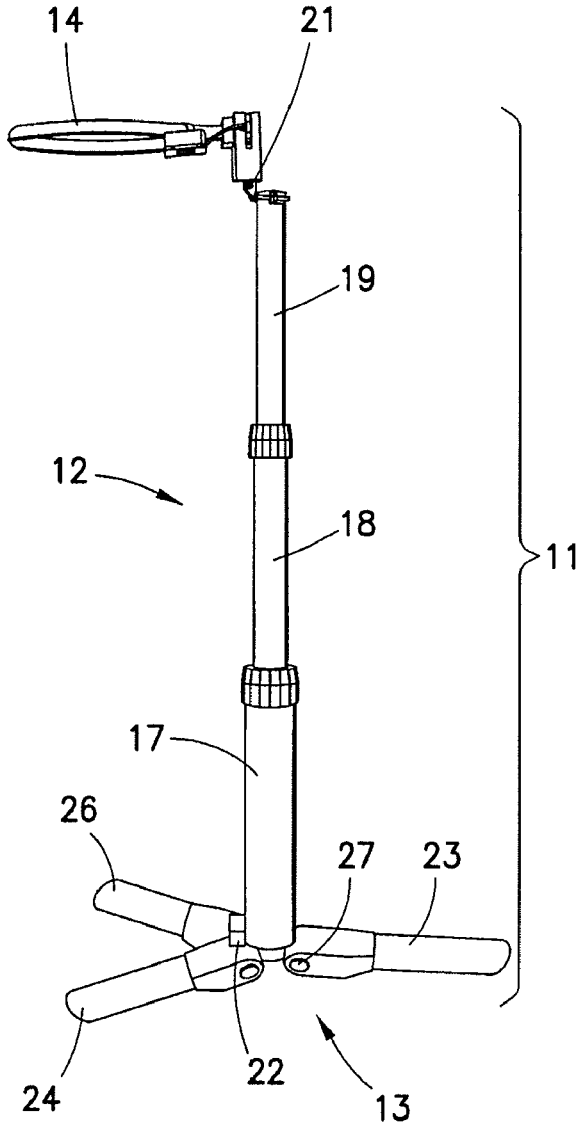
FIG. 1 is a perspective view of a portable tennis throw trainer constructed and arranged in accordance with to the invention.

FIG. 1 is an elevational view of a tennis throw trainer 11 including an adjustable extension pole 12 mounted on a base 13. Toss hoop 14 is mounted at the top of pole 12. Base 13 includes three hinged legs 16 that extend and lock in a horizontal position for supporting throw trainer firmly on the ground. The details of tennis throw trainer device 11 and its use will be described in more detail below.

Pole 12 is formed of at least two telescoping sections to allow for adjusting the height of toss hoop 14 and for collapsing pole 13 for convenient storage. In the illustrated embodiment, pole 13 includes a lower section 17, a middle pole section 18 and an upper pole section 19. The adjustable height allows a player to throw the ball to the correct height and angle for serves. It is within the scope of the invention to have less or more than three pole sections, or to make pole 13 a fixed length. A fixed length limits the use by people of varying height. Pole 13 can adjust from about four feet to twelve feet to suit every player's need. Pole 13 is formed of aluminum or a substantially rigid plastic material, such as polyvinyl chloride or polyethylene, such as used for a pool skimmer. This ensures that pole 13 is non-corroding.

Figure 2:
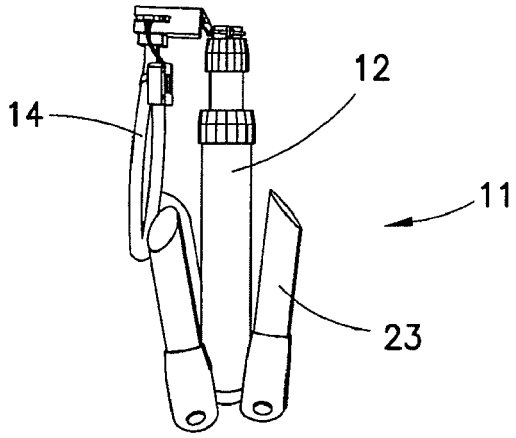
FIG. 2 is a plan view showing the portable tennis throw trainer of FIG. 1 in a collapsed condition for storage.
Figure 3:
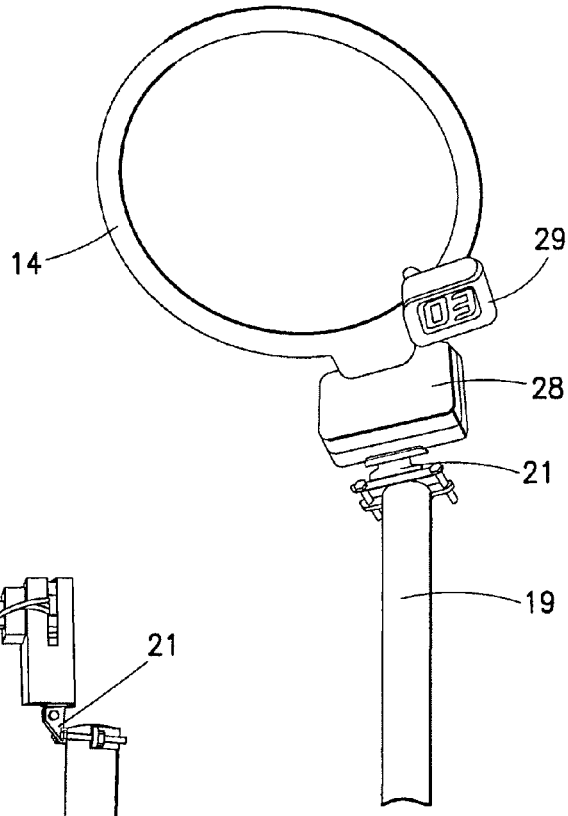
FIG. 3 is an perspective view of a toss hoop with a photo-sensor and indicator constructed and arranged in accordance with the invention.
Figure 4:
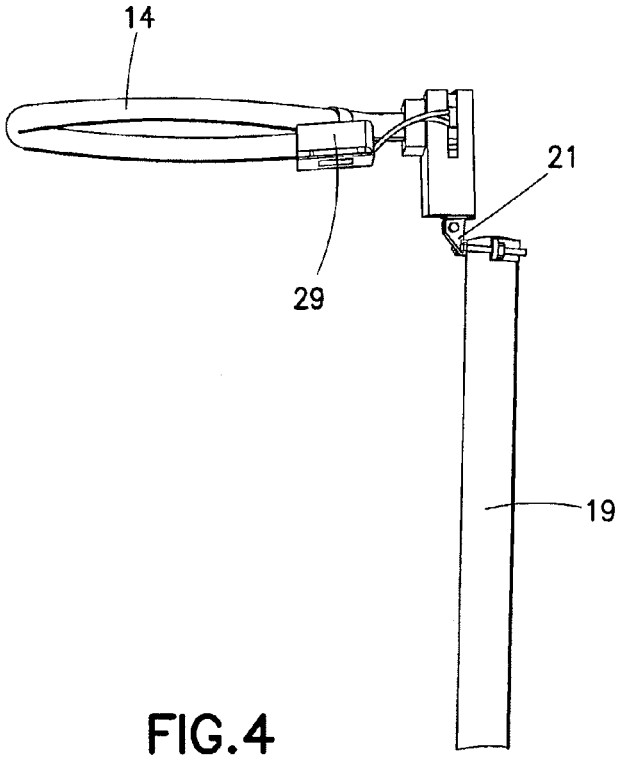
FIG. 4 is a side elevational view of the toss hoop and photo-sensor of FIG. 3.

Toss hoop 14 is mounted to upper pole section 19 by a hinge 21. This allows a user to collapse pole 12 and fold hoop 14 for easy transport and storage. Base 13 is a tripod base with legs 23, 24 and 26 for stability. Each of base legs 23, 24 an 26 are also mounted to the lower end of bottom pole section 17 by a locking base leg hinge 27. This allows folding of base legs 23, 24 and 26 when collapsing trainer device 11 for storage and shown in FIG. 2. Alternatively, legs may be connected by hinge pins to base 13 in grooves and fold away from pole section 19.

Toss hoop 14 may have a photo-sensor 28 and a counter 29 to let the player know when the ball travels through hoop 14. Counter 29 registers a valid toss with an audible tone and/or an increment in counter 29. A valid toss is recorded when a ball is tossed up through toss hoop 14 to a height of about 4 to 12 inches, preferably 6-8 inches above hoop 14 and descends back through hoop 14. A valid toss registered by counter 29 may also be indicated by an audible tone or both.

This allows a player to be able to zero in on the exact speed with which to throw the ball so that it stops right at the correct height above hoop 14. Use of photo-sensor 28 and counter 29 is ideal because it doesn't require the player to reset a light or alarm each time he or she serves. He or she can simply look to see if the counter has increased to verify that the ball went through the proper height and descended through toss hoop 14. Sensing is done with photo sensor 28 that increases counter 29 with each valid pass through. Photo-sensor and counter can be powered by conventional flash light type batteries that can easily be replaced. The user does not have to charge the device nor does he or she have to rely on AC power.

Figure 5:
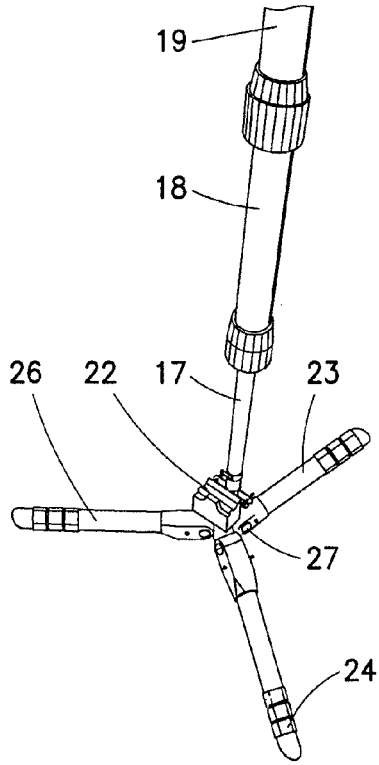
FIG. 5 is a perspective view of the base with legs in place in the device of FIG. 1.
Figure 6:
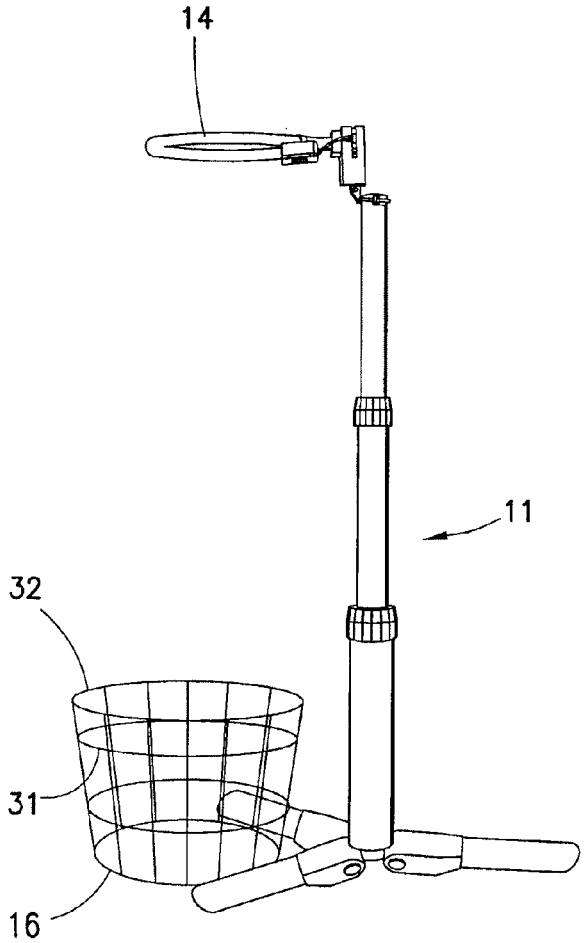
FIG. 6 is a perspective view of a portable tennis throw trainer with a ball catch container positioned at the base in accordance with the invention.

Toss hoop 14 folds away for easy storage and transport. Base 13 has three legs 23, 24 and 26 that also fold up so that players are more likely to bring toss training device 11 with them and use it more often to improve their serve and game. It is desirable to provide a pole that varies from about four feet to at least 10 or 12 feet so that a young child and a seven foot tall person can practice throws for his or her swing. An adjustable metal structure laundry basket 31 with a handle 32 as shown in FIG. 5 may be placed adjacent to Base 13 for retrieving tossed balls.

This disclosure provides a lightweight and collapsible solution that is a cost-effective, reliable tennis throw training device.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawing (s) shall be interpreted as illustrative and not in a limiting sense.

The present invention may be embodied in other specific forms without departing from the spirit or essential attributes of the invention.

What is claimed is:

1. A tennis throw trainer, comprising;

a base, a pole of suitable height for a player's height mounted to the base, wherein of aluminum;

a toss hoop mounted to the top of the pole by a hinge, a photo-sensor, mounted on the toss hoop to indicate a valid toss when a ball has passed upwardly a predetermined distance through the hoop and then descends through the hoop;

wherein the photo-sensor is connected to an audible alarm to indicate a valid toss; and the pole and toss hoop at a correct height and angle for serves so that a player can determine that the ball is tossed to the correct height and is vertical when it passes through and descents through the toss hoop.

2. A tennis throw trainer, comprising:

a base a pole of suitable height for aplayer's height mounted to the base, wherein the pole is formed of aluminum;

a toss hoop mounted to the top of the pole;

a container positioned at the base below the top hoop, a photo-sensor, mounted on the toss hoop to indicate a valid toss when a ball has passed upwardly a predetermined distance through the hoop and then descends through the hoop;

wherein the photo-sensor is connected to an audible alarm to indicate a valid toss; and the pole and toss hoop at a correct height and angle for serves so that a player can determine that the ball is tossed to the correct height and is vertical when it passed through and descents through the toss hoop.

* * * * *